United States Patent [19]

Mukoyama

[11] Patent Number: 4,707,144

[45] Date of Patent: Nov. 17, 1987

[54] TABLE CLOCK

[75] Inventor: Masumi Mukoyama, Tokyo, Japan

[73] Assignee: Seikosha Co., Ltd., Tokyo, Japan

[21] Appl. No.: 905,939

[22] Filed: Sep. 10, 1986

[30] Foreign Application Priority Data

Sep. 11, 1985 [JP] Japan ..... 60-139345[U]

[51] Int. Cl.[4] ..... G04F 5/00

[52] U.S. Cl. ..... 368/165; 368/179; 368/316; 368/317

[58] Field of Search ..... 368/179, 165, 134–138, 368/316, 317

[56] References Cited

U.S. PATENT DOCUMENTS

| | | | |
|---|---|---|---|
| 4,228,533 | 10/1980 | Siefert | 368/179 |
| 4,395,137 | 7/1983 | Wiley | 368/179 |
| 4,509,865 | 4/1985 | Chu | 368/179 |
| 4,525,078 | 6/1985 | Chu | 368/165 |
| 4,600,315 | 7/1986 | Nakamura | 368/179 |

FOREIGN PATENT DOCUMENTS

| | | | |
|---|---|---|---|
| 48310 | 10/1983 | Japan | 368/179 |
| 48311 | 11/1983 | Japan | 368/179 |
| 48401 | 1/1984 | Japan | 368/179 |

*Primary Examiner*—Bernard Roskoski

*Attorney, Agent, or Firm*—Bruce L. Adams; Van C. Wilks

[57] ABSTRACT

A table clock characterized in that a first pole member being electromagnetically driven is swingably supported at its middle portion by the back of a support body erecting one a base, the first pole member has at its lower end portion a bob and by the front side of its upper end portion is swingably supported a second pole member at the upper end portion thereof, and the second pole member has a clock body secured to its lower end portion.

14 Claims, 2 Drawing Figures

TABLE CLOCK

BACKGROUND OF THE INVENTION

The present invention relates to a movable table clock possessing interior design versatility and decorativeness.

Heretofore, one type of movable table clock which possesses interior decorativeness has been disclosed in (Japanese Patent Laid-Open No. 56-49972. This type is designed so that the whole clock body can swing reciprocatingly, hence, this type of table clock possesses dynamic interior decorativeness, as well as the ordinary function of displaying the time of day.

However, this type of table clock of the prior art provides only a very simple movement, is insufficient in interior decorativeness, and has the drawback that it is very difficult to read the time because the time display section of the clock body is also rotationally displaced.

SUMMARY OF THE INVENTION

In view of the foregoing, it is an object of the present invention to provide a table clock which presents a more complicated though more eye-pleasing movement to enhance interior decorativeness and which permits very easy reading of the time.

One feature of the present invention is that a first pole member is electromagnetically driven and is swingably supported at its middle or intermediate portion by the back portion of a support body erected on a base, the first pole member having at its lower end portion a bob and that by the front side of the upper end portion of the first pole member is swingably supported a second pole member at the upper end portion thereof, the second pole member having a clock body secured to its lower end portion.

Accordingly, as a lateral force is applied to the bob by electromagnetic driving means, the first pole member begins swing from side to side and its upper end undergoes circular movement with respect to its supporting point, but, the second pole member has the clock body at its lower end and this clock body serves as a weight, thus, the clock body always maintains its vertical posture irrespective of the swinging movement of the first pole member. Its vertical posture does not change appreciably even though the clock body undergoes circular movement in response to the circular movement of the upper end of the second pole member, and its time display section looks as if in a motionless state.

DETAILED DESCRIPTION OF THE INVENTION

An embodiment of the present invention will now be described with reference to the drawings.

Figure 1:
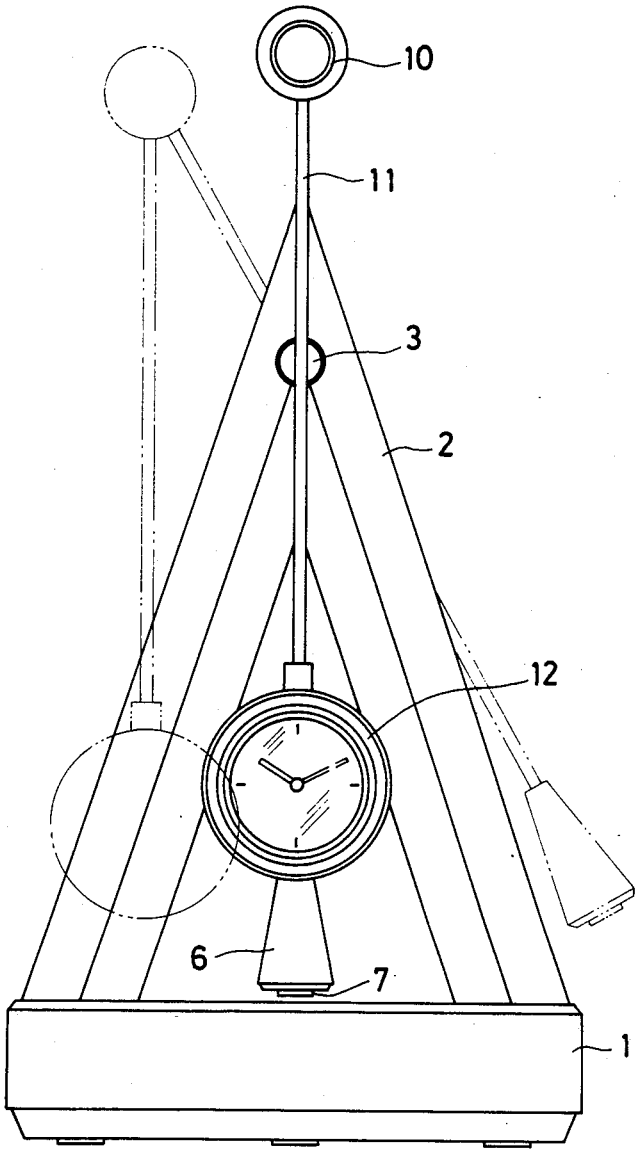
FIG. 1 is a front view of the table clock.
Figure 2:
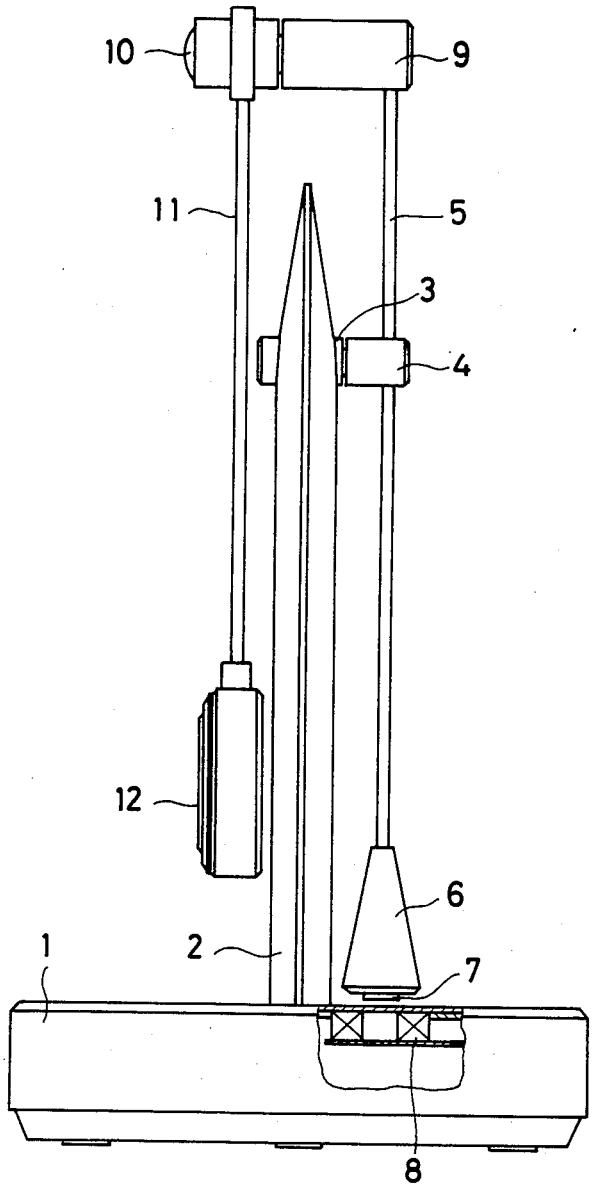
FIG. 2 is a side view of the table clock with a portion broken away.

As shown in FIG. 1, on a base 1 is vertically upwardly erected a hollow triangular support body 2, to the upper portion of the back face of this support body is secured a coupling member 3, and through another coupling member 4 rotatably coupled to this coupling member 3 passes movable supporting means in the form of a first longitudinal pole member 5. The coupling member 4 is positioned at a pivotal axis a little above the center of the first pole member 5. To the lower end of the first pole member 5 is attached a bob 6. A permanent magnet 7 provided on the lower end of this bob 6 is positioned in opposed relation to a driving coil 8 provided inside the base 1. To the upper end portion of the first pole member 5 is secured a coupling member 9 which projects laterally frontward, from the first pole member and to the front face of this coupling member 9 is rotatably coupled another coupling member 10. To this coupling member 10 is attached the upper end portion of hanging means in the term of a second pole member or rod 11, and at the lower end portion of this second pole member 11 is hung a clock body 12. The center of gravity of the first pole member 5 provided with the bob 6 and the coupling member 9 lies at a position lower than its support section or the coupling member 4. Since the clock body 12 serves as a weight, the center of gravity of the second pole member 11 also lies at a position lower than the coupling member 10.

The first pole member 5 is driven so as to oscillate or swing reciprocatingly by the electromagnetic force between the permanent magnet 7 and the driving coil 8. Thus, the coupling members 9 and 10 undergo turning movement about the coupling member 4, but, the second pole member 11 is always oscillated or displaced from side to side while maintaining its vertical posture or attitude, and the clock body 12 attached to the lower end of that member 11 undergoes circular and oscillating displacement while keeping its time display section in the direct vertical posture (as illustrated by the chain lines in FIG. 1).

Furthermore, depending upon the relation between the natural frequency of the first pole member 5 and the natural frequency of the second pole member 11, it is also possible to cause the second pole member 11 to swing in opposite phase to the first pole member 5. In this case, it is possible to add a swinging movement of the second pole member 5 about the coupling member 10 though degrading somewhat the easiness in time reading of the clock body.

According to the present invention, since there is presented a variety of "double" motion by the use only of a very simple configuration, the degree of interior decorationity is increased, and in case the second pole member is designed so as to be displaced from side to side while keeping the time display section in the vertical posture, the time can be read very easily. Further, since a few modes of double movement can be realized depending upon the relation between the first pole member and the second pole member, it is possible to promote still more a variety of movement.

What is claimed is:

1. A table clock comprising:

a base;

a support body disposed vertically on the base;

a first pole member swingably supported at its middle portion by said support body;

electromagnetic means including a driving coil provided in the base and a permanent magnet provided at the lower end portion fo the first pole member for driving the first pole member to swing the same about its middle portion;

a second pole member swingably supported at its upper end portion by said first pole member; and a clock body secured to the lower end portion of the second pole member such that as the first pole member is driven to undergo swinging movement by the electromagnetic means, the second pole member is also swung abouts its upper end portion thereby reciprocatingly displacing the clock body transversely of the support body without changing the vertical posture of the clock body.

2. A clock comprising: displaying means for displaying time; hanging means having upper and lower portions for hanging at the lower portion thereof the displaying means so that the same depends vertically downwardly from the upper portion so as to maintain the vertical attitude of the displaying means; movable supporting means for movably supporting the hanging means at the upper portion thereof, the movable supporting means being mounted to undergo oscillatory movement to thereby effect corresponding oscillatory displacement of the displaying means without changing the vertical attitude thereof; and driving means for driving the movable supporting means to undergo oscillatory movement.

3. A clock according to claim 2; wherein the hanging means comprises a rod rotatably supported at the upper portion thereof by the movable supporting means.

4. A clock according to claim 2; wherein the movable supporting means comprises a longitudinal member driven to swing in a vertical plane around a pivotal axis located at an intermediate portion of the longitudinal member.

5. A clock according to claim 4; wherein the longitudinal member includes means at the upper portion thereof protruding laterally therefrom for supporting the hanging means.

6. A clock according to claim 5; wherein the longitudinal member includes a bob at the lower portion thereof.

7. A clock according to claim 4; including a support body for pivotably supporting the longitudinal member at the pivotal axis thereof.

8. A clock according to claim 7; including a base for vertically upwardly supporting the support body.

9. A clock according to claim 8; wherein the driving means comprises a permanent magnet disposed at the lower portion of the longitudinal member, and a driving coil disposed on the base in opposed relation to the permanent magnet to apply thereto a magnetic force.

10. A clock according to claim 2; wherein the displaying means comprises a clock body.

11. A clock comprising: a base having an upstanding support portion; an elongate support member; means mounting the support member at one end portion thereof on the support portion so as to undergo back-and-forth movement while maintaining the support member in the same attitude throughout the back-and-forth movement; a clock body having means for keeping and displaying time and being mounted at the other end portion of the support member to undergo back-and-forth movement therewith while maintaining the clock body in the same attitude throughout the back-and-forth movement; and drive means for driving the support member and clock body back-and-forth.

12. A clock according to claim 11; wherein the means mounting the support member comprises means mounting the support member in a generally vertical posture such that the support member depends vertically downwardly and has the clock body mounted at the lower end portion thereof.

13. A clock according to claim 12; wherein the means mounting the support member includes a longitudinal member turnably mounted at an intermediate portion along the length thereof to undergo back-and-forth turning movement in a plane different from that in which the support member and clock body undergo back-and-forth movement, means at one end of the longitudinal member coacting with the drive means to effect back-and-forth turning movement of the longitudinal member, and means at the other end of the longitudinal member for transmitting the back-and-forth turning movement of the longitudinal member to the support member to effect back-and-forth movement of the support member and clock body.

14. A clock according to claim 11; wherein the means mounting the support member includes a longitudinal member turnably mounted at an intermediate portion along the length thereof to undergo back-and-forth turning movement in a plane different from that in which the support member and clock body undergo back-and-forth movement, means at one end of the longitudinal member coacting with the drive means to effect back-and-forth turning movement of the longitudinal member, and means at the other end of the longitudinal member for transmitting the back-and-forth turning movement of the longitudinal member to the support member to effect back-and-forth movement of the support member and clock body.

* * * * *